US005331710A

United States Patent [19]

Tollasepp

[11] Patent Number: 5,331,710

[45] Date of Patent: Jul. 26, 1994

[54] EDGER

[76] Inventor: Tonis Tollasepp, 120 Applefield Drive, Scarborough, Ontario, Canada, M1P 3Y2

[21] Appl. No.: 32,646

[22] Filed: Mar. 17, 1993

[51] Int. Cl.[5] ..... B05C 17/00

[52] U.S. Cl. ..... 15/210.1; 15/144.1; 15/145

[58] Field of Search ..... 15/210.1, 145, 176, 15/172, 202, 146, 144.1, 209.1, 244.1

[56] References Cited

U.S. PATENT DOCUMENTS 3,359,589 12/1967 Moore ..... 15/210.1
3,369,268 2/1968 Burns et al. ..... 15/210.1
3,629,894 3/1970 Stefany ..... 15/210.1
4,127,911 12/1978 Cupp et al. ..... 15/210.1
4,155,140 5/1979 Janssen et al. ..... 15/210.1
4,300,258 11/1981 Burns et al. ..... 15/210.1
4,794,663 1/1989 Vosbikian ..... 15/144.1
4,819,294 4/1989 Calvert ..... 15/144.1

*Primary Examiner*—Timothy F. Simone
*Assistant Examiner*—Patrick F. Brinson

[57] ABSTRACT

A paint edger has a paint pad with an application end on a handle and a spacer that slides from a retracted to an extended position so that it controls the approach of a paint pad to a surface perpendicular to that being painted.

8 Claims, 3 Drawing Sheets

EDGER

This invention relates to an assembly for the type of painting usually described as edging and trimming.

The following disclosure documents filed by me, cover subject matter thought to be relevant to the invention herein described.

| DISCLOSURE DOCUMENT | FILED |
|---|---|
| 256,923 | 29 JUN 90 |
| 286,740 | 15 JUL 91 |
| 309,784 | 18 MAY 92 |

In the field to which the invention relates, paint is applied to a surface, usually by roller but possibly by brush up to a line which is within a reasonable proximity of an intersecting transverse surface which is either not to be painted or to be painted a different colour. The intersecting transverse surface may be, for example, a window, a raised moulding or an intersecting full wall. The edger in accord with the invention is designed to allow the paint to be extended as close as desired the transverse surface with care and precision.

In accord with the invention a generally flat pad is provided, adapted to carry a small amount of paint and apply it to a surface or to advance paint already on an area of the surface, to adjacent areas on the surface. By 'paint pad' herein I include items presently known to the painting art as a "brush pad", a "pile brush pad" and a "pile brush".

The pad is generally flat and combined with a longitudinally extending shank to form a pad member. A spacer member is adapted to slide relative to the pad and comprises a spacer and a longitudinally extending shank.

The pad and the spacer are designated as being located forwardly of their respective shanks and the respective shanks are described as extending longitudinally 'rearwardly' from the respective pad and spacer. The paint pad is preferably provided with two forward edges converging in a forward direction. While such forward edges preferably converge to a point, it is an alternative to truncate the point so that an edge extends between the forward end of the converging edges. In accord with the intended use of the invention, the spacer in the retracted position, allows any of the pad edges to reach to the boundary of the surface being painted. However, the spacer with its longitudinally extending shank may be slid through a continuum of extended positions, in each of which a forward edge of the spacer extends forwardly beyond one or more of the application edges. Where such extension is provided, the extending spacer edge may contact a surface transverse to that being painted and control the proximity of the pad thereto. Thus, with the pad carrying paint from an outside supply, or from an area of the surface being painted, the paint may be applied to the surface being painted up to the desired proximity to the transverse surface as dictated by the extension amount of the spacer member. By progressively reducing the amount of the extension of the spacer beyond the pad, the paint may be progressively brought up to an exact line.

In a preferred form the paint pad is shaped to provide two forward edges converging at about 60 degrees to a point. The spacer is designed to overlie the pad in the retracted position and to provide forward spacer edges which are registrable with the pad edges, except that the converging forward spacer edges are truncated short of the point to be joined by a spacer edge transverse (although it need not be exactly perpendicular) to the convergence direction. With pad and spacer so shaped, then in any extended position, either ccnverging spacer edge will allow application of paint up to the amount determined by the spacer position. In sufficiently extended positions, the flat forward edge of the spacer member bearing on the transverse edge will supply spacing for the forward apex of the paint pad.

In accord with the invention the pad and the spacer are provided with longitudinally extending members adapted to slide on each other in the longitudinally direction. Preferably these members are collectively bendable about axes perpendicular to the longitudinal extension direction and parallel to the pad. Thus the longitudinally extending members may be held at a comfortable angle to the surface being painted and allow the pad to rest almost flat on such surface.

In drawings which illustrate a preferred embodiment of the invention :

Figure 1:
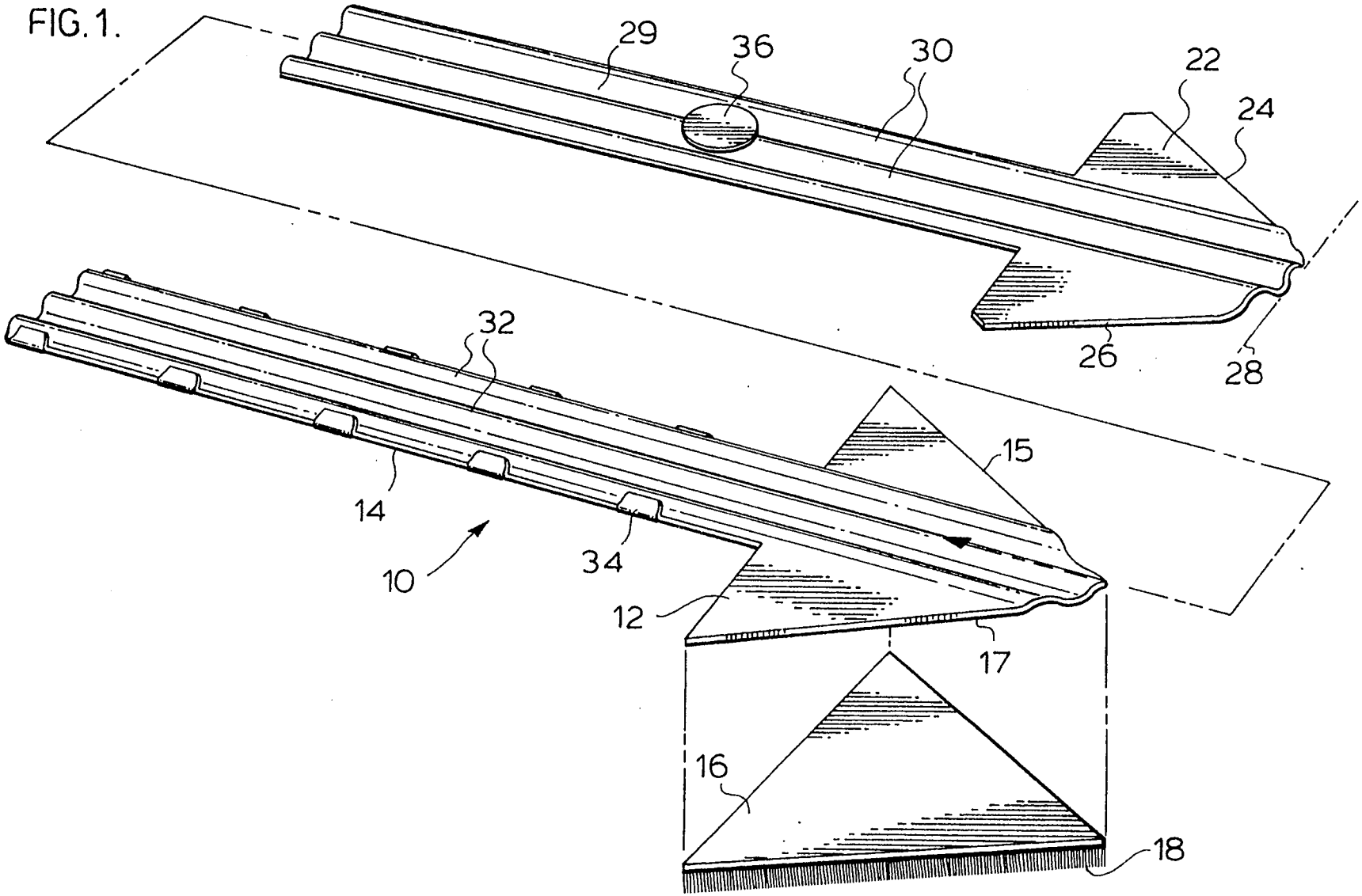
FIG. 1 is an exploded view showing the paint pad member and spacer member.

In the drawings the paint pad member 10 is of a flexible material preferably plastic, and shaped in plan to provide a triangular pad support 12 extending (preferably integrally) into a rearwardly longitudinally extending shank 14. The support 12 is preferably triangular with, in plan view, forward edges 15–17 converging at approximately 60 degrees. The angle may differ but about 60° is preferred. Other shapes, may be used within the scope of the invention.

On the lower side of the triangular pad support 12 is the similarly shaped pad 16 attached to the support by adhesive or in any other manner and having a downwardly directed pile fabric 18 suitable for holding and dispensing a small quantity of paint.

A spacer 22 is preferably similarly shaped to the pad except that the forward corner is truncated so that the spacer in plan defines forwardly converging spacer edges 24 and 26 converging at about 60° and a forward spacer edge 28 forming the truncation line. Longitdunally extending rearwardly from the spacer is the spacer shank 29 of similar length to shank 14. Longitudinal corrugations 30 are provided in the spacer and spacer shank which are complementary to corrugations 32 on the pad support and shank 14. Upwardly then inwardly curving ears 34 on the outside of the pad support shank 14 act as guides for longitudinal sliding of the spacer shank relative to the support shank. The spacer shank is preferably provided on its top side with a thumb contact pad 36. The lower surface of the support shank may be supplied with similar digital contacting portions also, but these are not usually found necessary. When retracted the spacer overlies the pad support. The pad 16 may be moved up to and into contact with a transverse surface 38. By grasping the shanks 14 and 29 , together with the fingers and pushing on the thumb portion, the spacer member may be moved forward through a continuum of spacer positions where a forward edge of the spacer is forward of the pad edge to correspondingly limit the approach of the pad to a transverse surface 38.

Figure 4:
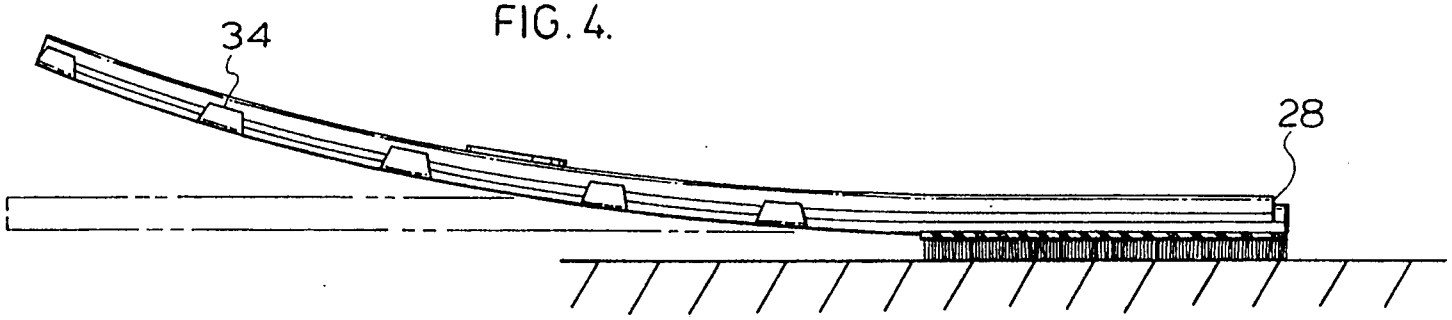
FIG. 4 is a side view of the invention in use.
Figure 5:
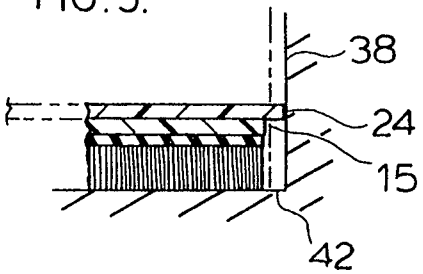
FIG. 5 is a section along the lines 5—5 of FIG. 3.

When manually held, the longitudinally extending shanks 14 and 29 may be conveniently held at a small angle to the surface to be painted with the pad oriented toward such surface, While holding such longitudinally extending shanks, they may be pressed toward the surface to be painted with the pile 18 in contact therewith. Such pressure causes the side-by-side longitudinally extending shanks 14 and 29 to resiliently bend as best shown in FIG. 4 so that the pad may assume a working position parallel to the surface being painted. Given that the complementary corrugations in the longitudinally extending shanks run perpendicular to the axes of flexure bending action, it may be found surprising that the shanks will resiliently bend. The corrugations are, of course, provided to add strength to the shanks. However, applicant has had no problem with such flexure, or, in other words, no problem with finding plastic for such shanks that allows such resilient flexure and without fracture of the shanks. (Obviously other shank shapes may be provided which will allow both relative sliding and the desired flexure).

Figure 2:
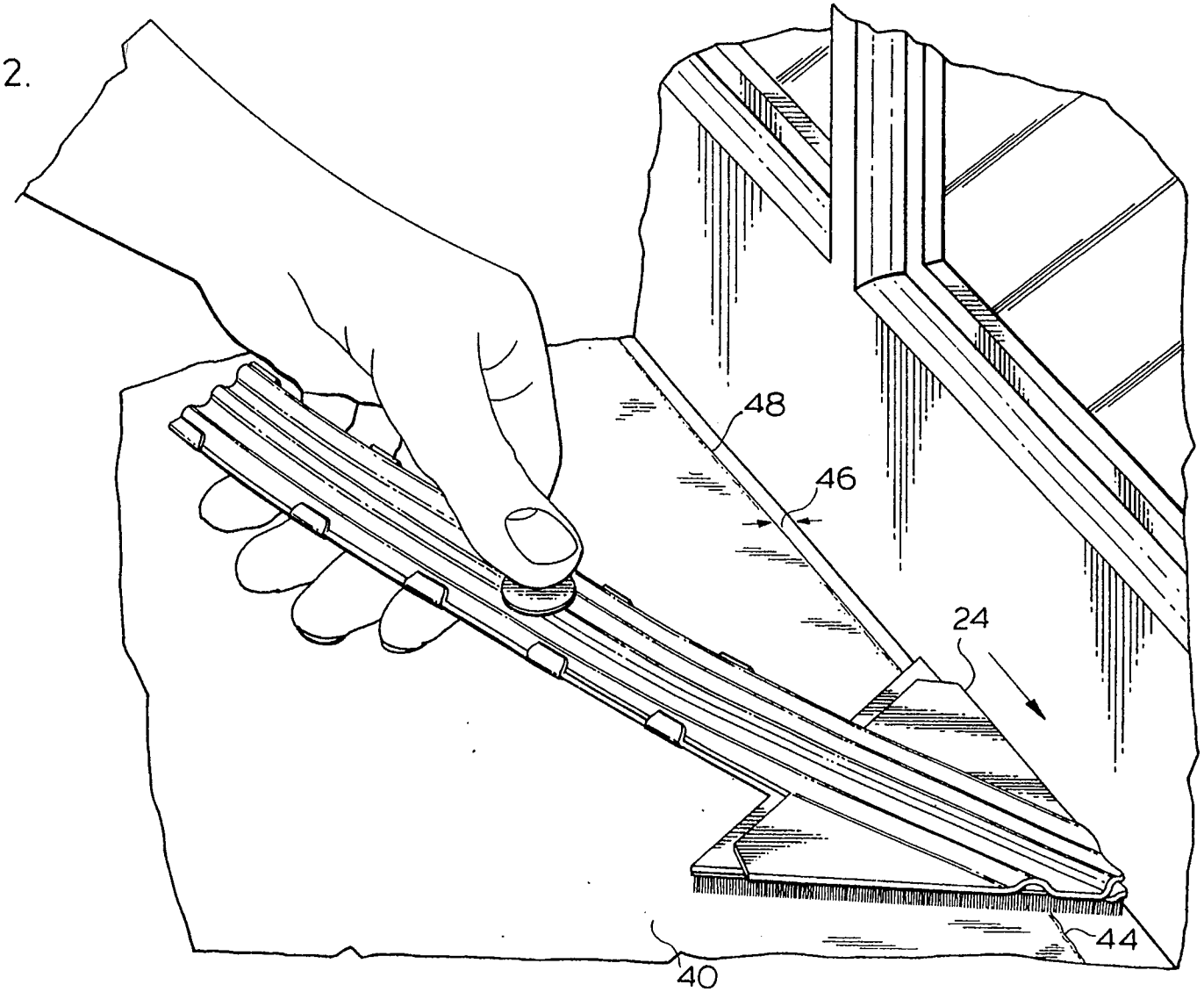
FIG. 2 shows the invention in use.
Figure 3:
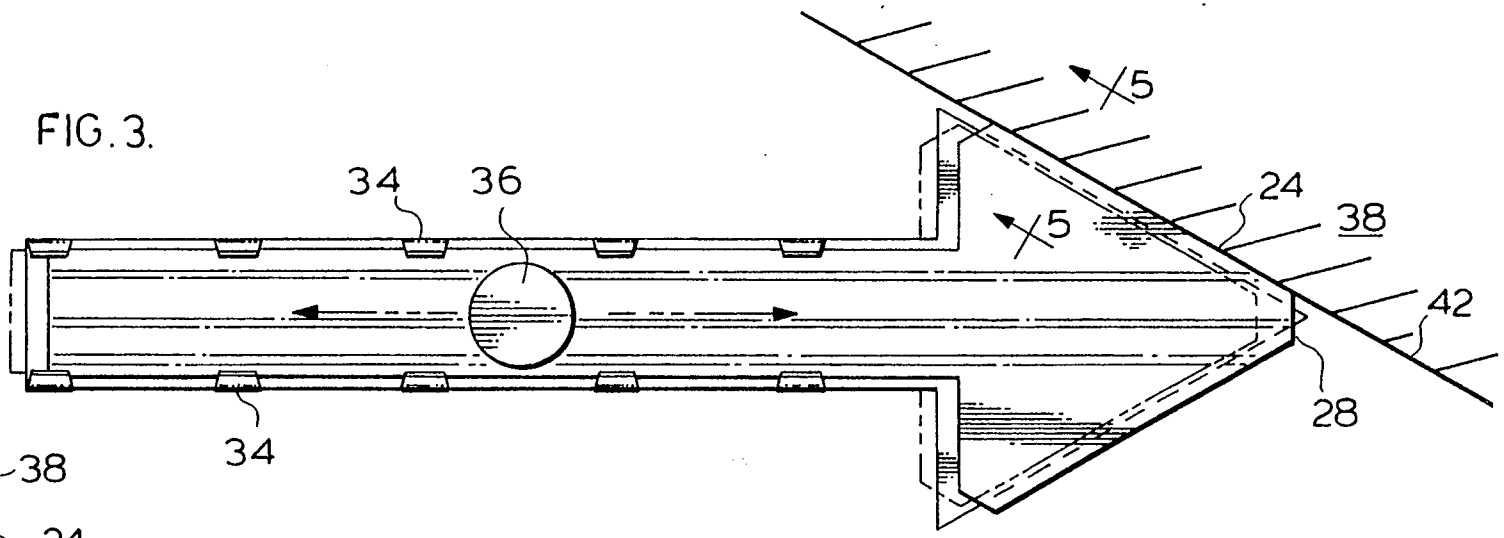
FIG. 3 is a plan view of the invention in use.

With the device as shown in FIG. 2, the surface 40 to be painted is seen meeting a transverse surface 38 (which is not to be painted) and where an accurate edge of the paint surface must correspond to the intersection line 42 of the surfaces. Thus, the paint may be applied to the painting surface 40 in a conventional manner (i.e.) by roller or brush up to line 44 at a safe gap from surface 38 to avoid paint splashes or smears on the latter. Then the edger in accord with the invention may be employed, applying the thumb to move the spacer 22 forward relative to the pad to obtain through a forward edge (here 24) the desired spacing 46 from the transverse wall. In setting the desired spacing, the user has selected which of the three forward edges will be used. In this description it is assumed that edge 24 has been selected. Edge 24 is, therefore advanced forwardly beyond the corresponding pad support edge 15. Edge 24 would be advanced to a distance so that when the spacer edge 24 contacts the transverse surface 38, the pad somewhat narrows the gap, between the surface already painted and the transverse surface, to line 46. The paint pad is loaded with paint. This may be done from the surplus paint already in place up to line 44 or may be done by applying paint to the pad from a roller or otherwise.

The paint on the pad is then applied to the surface while the spacer edge 24 bears on the transverse surface 38 with the fingers holding the shanks 14 and 29 against relative movement, and the painted surface is thus advanced to line 48.

When the painted surface has been thus advanced, the shanks may be digitally manipulated to reduce the spacing, the pad loaded and the painted surface again advanced. Thus this process may be continued until the painted surface is applied to its desired final line relative to the transverse surface, Spacer edges 24 or 26 will be most commonly employed. Spacer edge 28 may be used when it is advanced forwardly beyond the pad 16 apex. However, for most people it is difficult to work with the shanks perpendicular to surface 38.

The paint pad may have other shapes than the preferred one shown. However, the edges of the pad should converge in a forward direction. The edges of the paint pad need not be straight as long as spacing for the contour used may be conveniently provided by the spacer edges. The contour of the spacer need not correspond to that of the paint pad, but the operating edges of the spacer member (those extendable forwardly beyond the pad, should provide straight surfaces for accurate location of the spacer on the transverse surface.

The two longitudinal shanks may be arranged to longitinally slide relative to each other by any suitable shaping. However, it is desireable that the method used allow the spacer to be as close as possible to the pad support to allow the spacer to more accurately position the pad.

I claim:

1. A device for paint edging including:

a paint pad member comprising a paint pad and a longitudinally extending shank, extending rearwardly therefrom, a spacer member comprising a spacer and a longitudinally extending shank, extending rearwardly therefrom, said spacer being located adjacent and above said paint pad and said spacer member shank being located just above said paint pad member shank, means for guiding said spacer member for sliding movement in said longitudinal extending direction relative to said paint pad member, said guiding means guiding said sliding movement between a retracted position where forward edges of said paint pad are at least as far forward as forward edges of said spacer and a continuum of extended positions where forward edges of said spacer are located forwardly of forward edges of said paint pad, wherein said longitudinally extending paint pad shank and said spacer member shank are together resiliently bendable about axes parallel to said pad surface and perpendicular to said longitudinal extension direction.

2. A device as claimed in claim 1 wherein said spacer is forwardly defined by edges including a pair of forwardly converging edges and a surface generally transverse to said longitudinal sliding direction at the forward end of said converging surface.

3. Devices as claimed in claim 1 wherein said paint pad is, at its forward end defined by a pair of forwardly converging edges.

4. Devices as claimed in claim 3 wherein said spacer is forwardly defined by edges including a pair of forwardly converging edges and a surface generally transverse to said longitudinal sliding direction at the forward end of said converging edges.

5. A device as claimed in claim 1 wherein each shank is corrugated as viewed in section perpendicular to said longitudinally extending direction and said shank corrugations are shaped to be mutually complementary so that one shank may slide while in contact with the other.

6. A device as claimed in claim 2 wherein each shank is corrugated as viewed in section perpendicular to said longitudinally extending direction and said shank corrugations are shaped to be mutually complementary so that one shank may slide while in contact with the other.

7. A device as claimed in claim 3 wherein each shank is corrugated as viewed in section perpendicular to said longitudinally extending direction and said shank corrugations are shaped to be mutually complementary so that one shank may slide while in contact with the other.

8. A device as claimed in claim 4 wherein each shank is corrugated as viewed in section perpendicular to said longitudinally extending direction and said shank corrugations are shaped to be mutually complementary so that one shank may slide while in contact with the other.

* * * * *